US008090288B2

(12) United States Patent
Hano

(10) Patent No.: US 8,090,288 B2
(45) Date of Patent: Jan. 3, 2012

(54) METHOD AND APPARATUS FOR CLEANING AN IMAGE FORMING APPARATUS

(75) Inventor: Masami Hano, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 97 days.

(21) Appl. No.: 12/642,239

(22) Filed: Dec. 18, 2009

(65) Prior Publication Data

US 2010/0158558 A1 Jun. 24, 2010

(30) Foreign Application Priority Data

Dec. 24, 2008 (JP) ..... 2008-328014

(51) Int. Cl.
*G03G 15/02* (2006.01)
*G03G 21/00* (2006.01)

(52) U.S. Cl. ..... 399/100; 399/98

(58) Field of Classification Search ..... 399/98, 399/100, 101, 171
See application file for complete search history.

(56) References Cited

U.S. PATENT DOCUMENTS 3,942,006 A * 3/1976 Hayne ..... 399/100
3,944,356 A * 3/1976 Hayne ..... 399/100
5,485,255 A * 1/1996 Reuschle et al. ..... 399/100 X
7,212,771 B2 * 5/2007 Tanaka et al. ..... 399/171
7,272,337 B2 * 9/2007 Owens ..... 399/100
7,412,186 B2 * 8/2008 Sekovski et al. ..... 399/100
2008/0159776 A1 * 7/2008 Tanase ..... 399/100
2008/0247782 A1 * 10/2008 Sato et al. ..... 399/171

FOREIGN PATENT DOCUMENTS

JP 2003-295585 A 10/2003
JP 2004-085814 A 3/2004
JP 2006-091484 A 4/2006

* cited by examiner

*Primary Examiner* — Sandra Brase
(74) *Attorney, Agent, or Firm* — Canon U.S.A. Inc., I.P. Division

(57) ABSTRACT

An image forming apparatus includes a photosensitive member configured to form a toner image thereon, a corona charger located opposite the photosensitive member and including a discharging wire and a grid electrode, a bias applying unit configured to apply a bias to the corona charger, a cleaning unit configured to perform cleaning processing by sliding in a longitudinal direction of the grid electrode to rub an inner surface of the grid electrode, and an execution unit configured to execute a cleaning mode for performing the cleaning processing by the cleaning unit while applying a bias of a polarity equal to a normal charging polarity of toner to the grid electrode by the bias applying unit.

4 Claims, 16 Drawing Sheets

METHOD AND APPARATUS FOR CLEANING AN IMAGE FORMING APPARATUS

BACKGROUND OF THE INVENTION

1. Field of the Invention

The present invention relates to an image forming apparatus such as a copying machine, a printer, a facsimile, or a multifunction peripheral that includes a plurality of these functions.

2. Description of the Related Art

A conventional electrophotographic image forming apparatus performs image formation through an electrophotographic process that includes charging, exposing, developing, and transferring. This charging process charges a photosensitive member to a desired potential by using a corona charger.

The corona charger includes a meshed grid electrode disposed in its shield opening to set a surface potential of the photosensitive member to a desired potential. Due to a shape of the grid electrode, floating toner is easily deposited on an inner surface (side close to a discharging wire) of the grid electrode. Deposition of a great amount of such foreign objects on the inner surface of the grid electrode causes a charging failure in the inner surface. As a result, image density unevenness may occur.

Thus, Japanese Patent Application Laid-Open No. 2006-362960 discusses a technology for preventing deposition of a great amount of toner on a grid electrode by providing a cleaner configured to clean an inner surface of the grid electrode. Specifically, the cleaner cleans the inner surface of the grid electrode by bringing a cleaning brush into contact with the inner surface of the grid electrode and reciprocating the cleaning brush in a longitudinal direction of the grid electrode.

However, in the case of the cleaner for cleaning the inner surface of the grid electrode discussed in Japanese Patent Application Laid-Open No. 2006-362960, the following problem is inevitable. The toner stuck to the inner surface of the grid electrode slides to be rubbed by the cleaning brush, thereby passing through mesh openings to an outer surface (side close to the photosensitive member) of the grid electrode.

The cleaner discussed in Japanese Patent Application Laid-Open No. 2006-362960 cannot remove the toner that has passed through the mesh openings of the grid electrode to the outer surface to be deposited. Hence, a charging failure may occur.

Providing a cleaner for cleaning the outer surface of the grid electrode may enable prevention of this problem.

However, the corona charger for improving charging efficiency is disposed extremely close (gap is about 1 mm) to the photosensitive member, and hence this arrangement may not be a practical solution to the problem.

SUMMARY OF THE INVENTION

The present invention is directed to an image forming apparatus capable of appropriately removing toner passing through mesh openings of a grid electrode to an outer surface side during cleaning processing of an inner surface of the grid electrode.

According to an aspect of the present invention, an image forming apparatus includes a photosensitive member configured to form a toner image thereon, a corona charger located opposite the photosensitive member and including a discharging wire and a grid electrode, a bias applying unit configured to apply a bias to the corona charger, a cleaning unit configured to perform cleaning processing by sliding in a longitudinal direction of the grid electrode to rub an inner surface of the grid electrode, and an execution unit configured to execute a cleaning mode for performing the cleaning processing by the cleaning unit while applying a bias of a polarity equal to a normal charging polarity of toner to the grid electrode by the bias applying unit.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1:
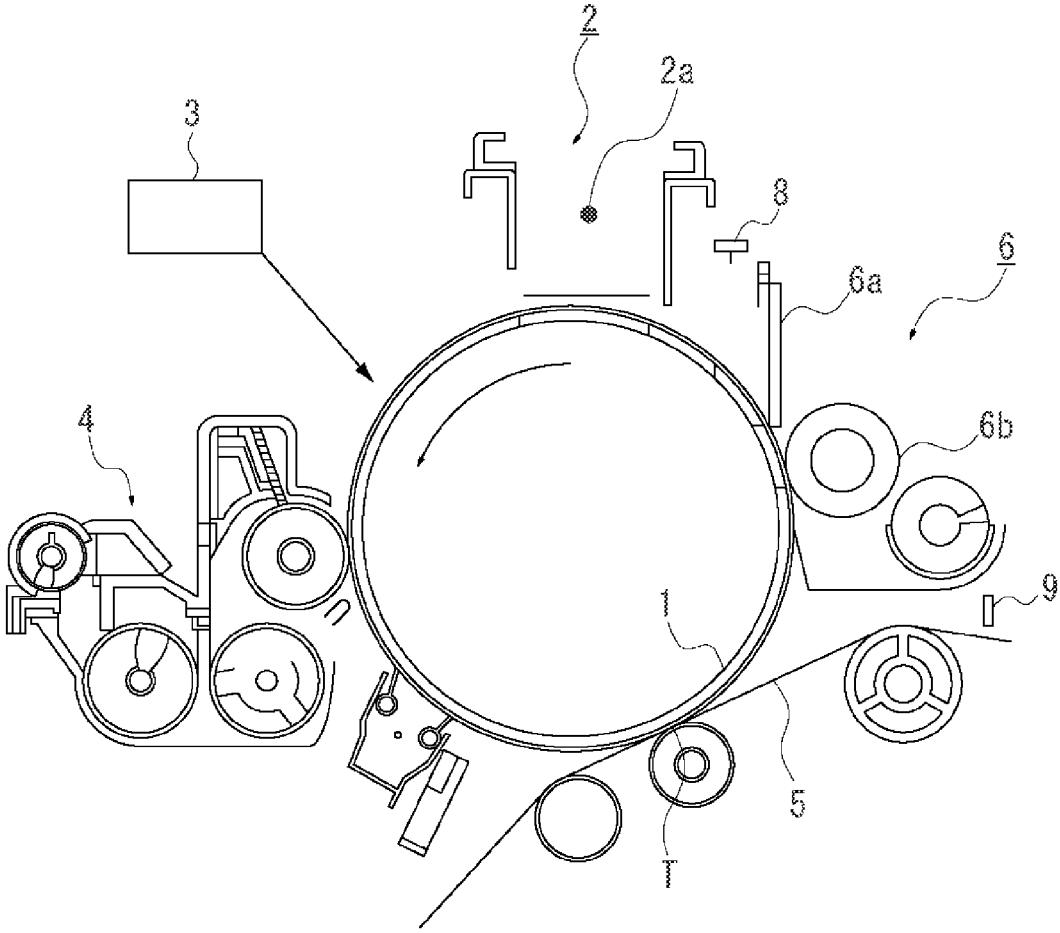
FIG. 1 is a schematic sectional diagram illustrating an image forming unit.

FIG. 1 illustrates a schematic configuration of an image forming apparatus. The image forming apparatus is an electrophotographic printer that performs image formation by using an electrophotographic process.

Specifically, a charging device 2 uniformly charges a surface of a photosensitive member 1. Then, an image exposing device 3 performs image exposure processing based on image information input from a personal computer (hereinafter, referred to as a PC) connected to the image forming apparatus via a network cable.

A developing device 4 sticks toner to an electrostatic latent image formed on the photosensitive member 1 through the image exposure processing to make the image visible. Then, a transfer device 5 transfers a toner image formed on the photosensitive member 1 to a sheet (transfer target member), and a fixing device (not illustrated) fixes the toner image on the sheet.

On the other hand, a cleaning device 6 removes toner left on the photosensitive member 1 without being transferred to the sheet to be recovered. Then, in order to cancel potential history remaining corresponding to the electrostatic latent image formed on the photosensitive member 1, optical discharging devices 8 and 9 apply rays of light to be used for next image formation.

The drum type photosensitive member 1 as an image bearing member includes a photosensitive layer (organic semiconductor) of negative charging characteristics on a hollow cylindrical core. The photosensitive member 1 has a diameter of 84 mm, and is rotated and driven in arrow direction at a process speed (circumferential speed) of 285 mm/second by a drive motor.

A corona charger 2 as a charging device includes a stainless steel shield serving as an electric shield, a discharging wire 2*a*, and a grid electrode 10 (hereinafter, referred to as a grid). The corona charger 2 further includes a discharging wire power source 100 and a grid power source 200 that function as bias applying units for applying a bias to the corona charger 2 (discharging wire 2*a* and grid electrode 10).

Stainless steel, nickel, or tungsten may advisably be used for the discharging wire 2*a*. In this exemplary embodiment, a tungsten wire having a diameter of 60 μm is used. A holding member integrated with the shield holds the discharging wire 2*a* by a fixed tensile force, and a holding member made of an insulating material maintains electric insulation between the discharging wire 2*a* and the shield.

Figure 4:
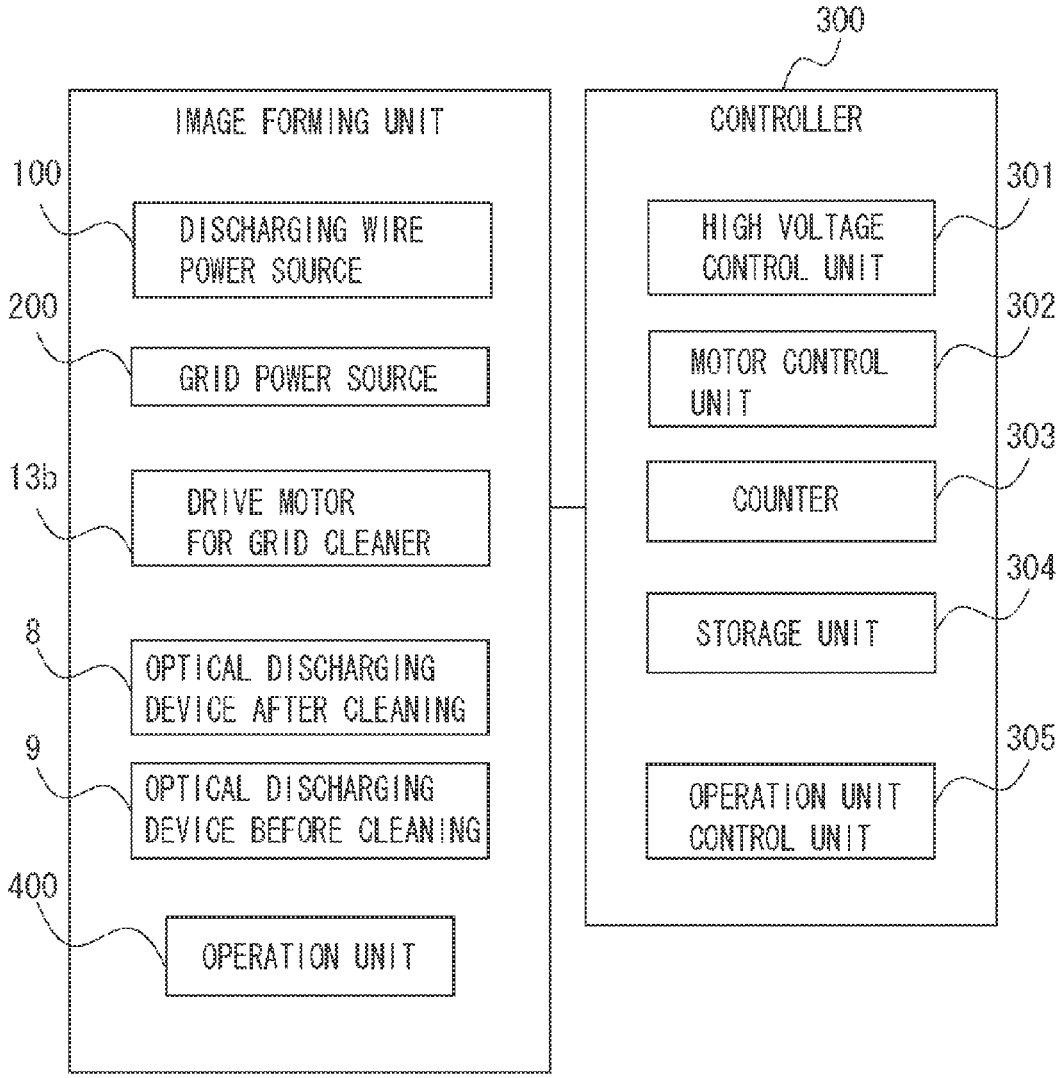
FIG. 4 is a block diagram illustrating a control system.

The discharging wire power source 100 illustrated in FIG. 4 for applying a voltage to generate corona discharging is connected to the discharging wire 2*a*. During image formation, the discharging wire power source 100 applies a DC voltage of a negative polarity (polarity equal to charging characteristics of the photosensitive member or a normal charging polarity of toner) to the discharging wire 2*a* (in this exemplary embodiment, −1000 μA is applied under constant current control). The discharging wire power source 100 is controlled by a high voltage control unit 301.

The grid 10 is a meshed electrode located close to the photosensitive member (gap is about 1 mm) in the opening of the shield (side close to the photosensitive member 1). In other words, the grid 10 is attached to the shield. Specifically, the grid 10 is formed into a porous shape where a plurality of holes is formed to penetrate a side facing the photosensitive member 1 and a side facing the discharging wire 2*a*.

Figure 3:
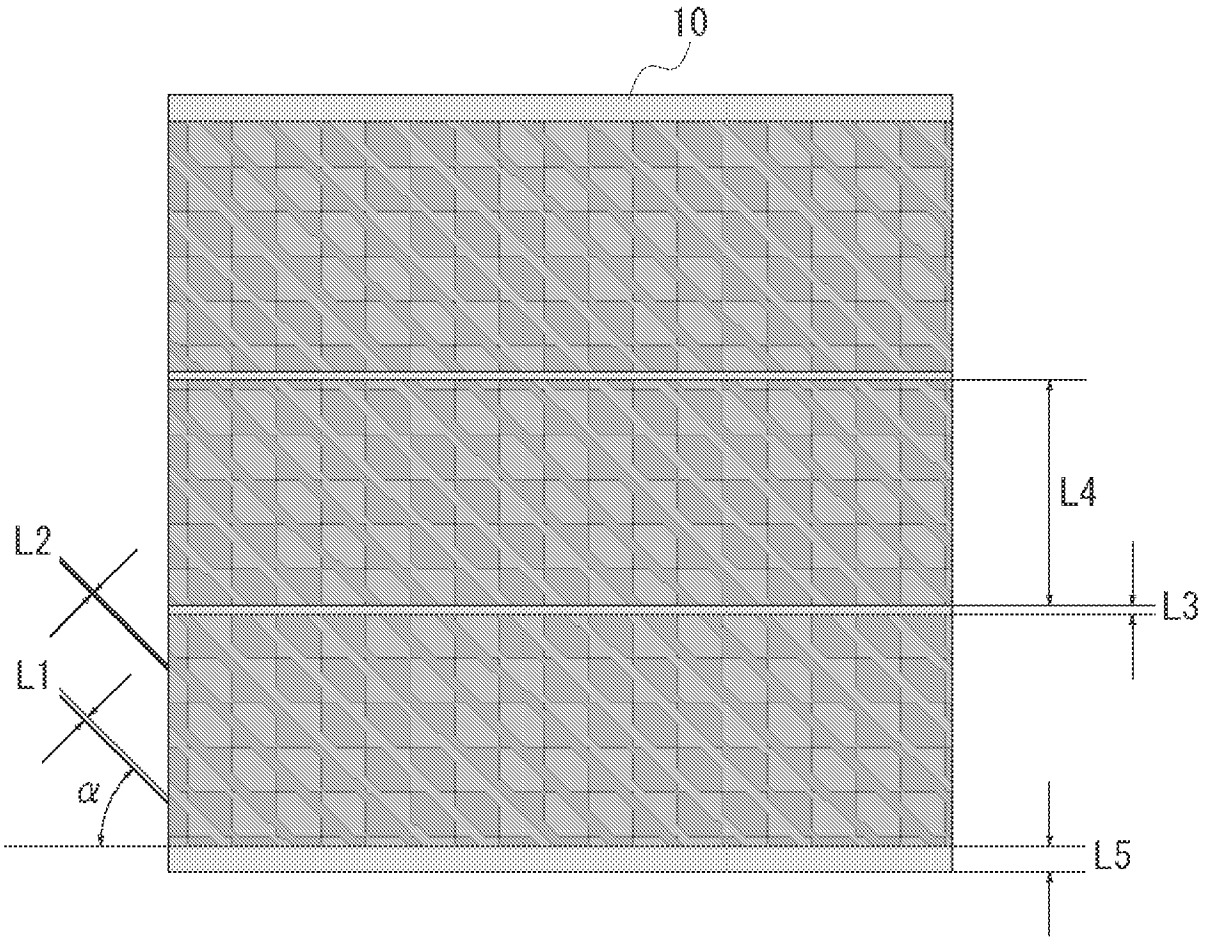
FIG. 3 is an enlarged schematic diagram illustrating a grid.

FIG. 3 is a partially enlarged diagram of the grid 10, specifically illustrating a meshed shape of the grid 10. The grid 10 uses, as its base material, a sheet metal made of austenitic stainless steel (SUS 304) and having a thickness of about 0.03 mm. The sheet metal is etched to form many through-holes. The grid 10 formed by the etching processing has a meshed internal shape. The etching processing is performed so that an angle α to a base line can be 45°.

As a result, a width of an opening L1 is 0.312 mm, and a width of a portion L2 that becomes a shielded portion is 0.071 mm. These portions having widths L1 and L2 are alternatively formed. A width L4 is 6.9 mm, and a beam is provided for each width L4 to prevent distortion of the grid 10. A width L3 of the beam is 0.1 mm. A width L5 of a thick beam located in each of both ends of a widthwise direction of the grid 10 is 1.5 mm.

The grid power source 200 illustrated in FIG. 4 is connected to the grid 10 to stabilize a surface potential of the photosensitive member 1 by efficiently guiding ions generated by the discharging wire 2*a* to the photosensitive member. The grid power source 200 applies, during image formation, a DC voltage of a negative polarity (polarity equal to charging characteristics of the photosensitive member or normal charging polarity of toner) to the grid 10 (in this exemplary embodiment, −800 V is applied under constant voltage control). The grid power source 200 is controlled by the high voltage control unit 301.

As a result, during the image formation, the corona charger 2 uniformly charges a surface of the photosensitive member 1 to −780 V.

The image exposing device 3 includes a semiconductor laser configured to perform image exposure for the photosensitive member 1 whose surface has been uniformly charged by the charging device 2 based on image information.

In this exemplary embodiment, an example using the semiconductor laser is described. However, a light emitting diode (LED) may be used.

The developing device 4 includes a development container configured to store a two-component developer which is a mixture of nonmagnetic toner and a magnetic carrier, and a development sleeve rotatably disposed in an opening of the development container. The toner is friction-charged to a negative polarity by slide-rubbing with the magnetic carrier.

This exemplary embodiment uses toner having an average particle diameter of about 6 μm, which results from milling and classifying particles obtained by kneading a pigment with a resin binder mainly containing polyester. For the carrier, a metal such as surface-oxidized or nonoxidized iron, nickel, cobalt, manganese, chrome, or rare earth, an alloy thereof, or oxide ferrite can be suitably used. There are no restrictions on a production method of such magnetic particles.

The carrier has a volume average particle diameter of 20 to 50 μm, preferably 30 to 40 μm, and a resistivity of $10^7$ Ωcm or higher, preferably $10^8$ Ωcm or higher. This exemplary embodiment uses a carrier obtained by coating a core mainly containing ferrite with a silicon resin and having a volume average particle diameter of 35 μm, a resistivity of $5\times10^9$ Ωcm, and a magnetization amount of 200 emu/cc. Such toner and a carrier are mixed at a rate of about 8:92 by weight to be used as a two-component developer having a toner density (TD ratio) of 8%.

The development sleeve has a function of magnetically holding a developer in the development container by a magnet fixed therein, and conveying the developer to a development unit that is a gap portion with the photosensitive member 1.

The development sleeve has a development power source connected thereto to apply a developing bias superimposing a DC current (−650 V) and an AC voltage (Vpp is 1800 V). Toner is stuck to an electrostatic image by the developing bias to perform development processing. The development power source is controlled by the high voltage control unit 301 of the controller 300 illustrated in FIG. 4. In this case, a charge amount of the toner stuck to the photosensitive member 1 is about −30 μC/g.

The transfer device 5 includes an intermediate transfer belt (transfer target member) tightened by a plurality of suspension rollers, and a transfer roller located opposite the photosensitive member 1 via the intermediate transfer belt. The transfer roller causes a region where the intermediate transfer belt and the photosensitive member are pressed into contact with each other to become a transfer portion T.

The transfer roller has a transfer power source connected thereto to apply a transfer bias (+1.6 kV in this exemplary embodiment) of a polarity reverse to a normal charge polarity (negative polarity) of toner. This transfer bias enables primary-transferring of a toner image formed on the photosensitive member 1 to the intermediate transfer belt. The transfer power source is controlled by the high voltage control unit 301 of the controller 300 illustrated in FIG. 4. Then, the toner image that has been transferred to the intermediate transfer belt is secondary-transferred to a sheet (transfer target member).

The cleaning device 6 that cleans the photosensitive member includes a fur brush 6*b* and a cleaning blade 6*a* configured to remove toner remaining on the photosensitive member 1. The toner thereby removed is recovered in a recovery container.

As illustrated in FIG. 1, in order to cancel history of an electrostatic image remaining on the photosensitive member, this exemplary embodiment includes the after-cleaning optical discharging device 8 and the before-cleaning optical discharging device 9 as light irradiation units to apply light. These devices include light emitting units for irradiating the photosensitive member 1 with light in order to remove the electrostatic image remaining on the photosensitive member 1 after the transfer processing of the transfer device 5.

The after-cleaning optical discharging device 8 and the before-cleaning optical discharging device 9 use, as the light emitting units, units formed by processing LED chips for applying light having a center wavelength of 660 nm into array shapes.

Operations of the after-cleaning optical discharging device 8 and the before-cleaning optical discharging device 9 are controlled by the high voltage control unit 301 of the controller 300. Specifically, discharging conditions such as ON/OFF timing and a light amount are controlled.

In this exemplary embodiment, a fixing device (not illustrated) is provided. The fixing device includes a fixing roller and a pressure roller. At a press-contact portion between these rollers, the toner image secondary-transferred to the sheet is heated and pressured to be fixed to the sheet. Then, the sheet is discharged out of the apparatus to complete the series of image forming operations.

Next, the cleaning device of the grid 10 and a cleaning processing flow of the cleaning device will be described in detail.

Figure 2:
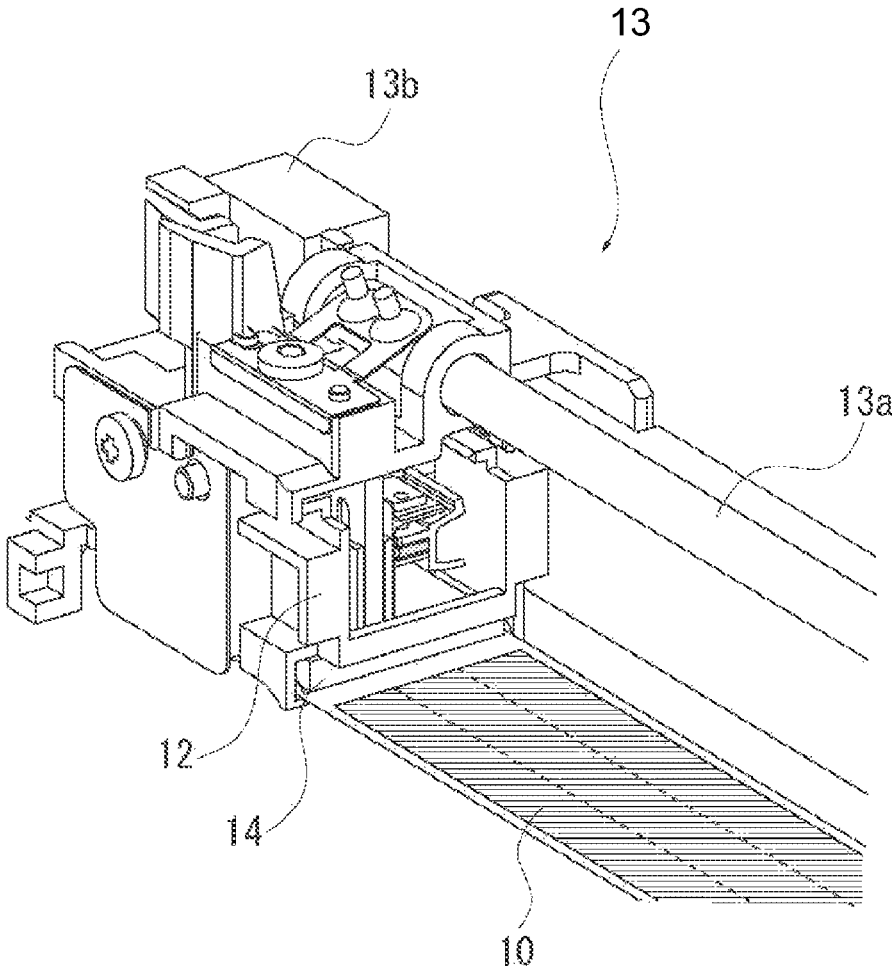
FIG. 2 is a schematic perspective diagram illustrating a charging device.

FIG. 2 illustrates the grid cleaning device that is a cleaning unit. The grid cleaning device includes a grid cleaning member 14 that can slide on an inner surface of the grid 10. The grid cleaning device 14 further includes a cleaning support 12 and a driving mechanism 13 constituting a movement mechanism for reciprocating the grid cleaning member 14 in a longitudinal direction of the grid 10.

The grid cleaning member 14 is for removing foreign objects such as toner stuck to the inner surface of the grid 10. For this purpose, the grid cleaning member 14 is provided so as to be brought into contact with the inner surface of the grid 10. As described below, when reciprocated by the driving mechanism 13, the grid cleaning member 14 cleans the grid 10 while sliding to rub the inner surface of the grid 10.

In this exemplary embodiment, for the grid cleaning member 14, a member obtained by fire-resistant processing an acrylic brush to weave it in foundation cloth is used. Other members such as nylon, PVC, and PPS may be used. Not limited to a flocked fabric, an elastic member such as a felt or a sponge, or a sheet coated with abrasives such as alumina or silicon carbide may be used. In other words, there are no restrictions on materials as long as slide-rubbing with the grid 10 can be performed smoothly.

The cleaning support 12 is for holding the grid cleaning member 14 on a screw shaft 13*a* of the driving mechanism 13. The cleaning support 12 includes a helical groove formed in an inner peripheral surface of its engaging hole with the screw shaft 13*a*. Rotation of the screw shaft 13*a* enables movement of the grid cleaning member 14 in the longitudinal direction of the grid 10.

As illustrated in FIG. 2, the driving mechanism 13 includes the screw shaft 13*a* and a drive motor 13*b* for rotating and driving the screw shaft 13*a*. Thus, in the case of cleaning the grid 10, the drive motor 13*b* is driven to rotate the screw shaft 13*a*. This rotation of the screw shaft 13*a* enables movement of the grid cleaning member 14 from a standby position set on a longitudinal one end side of the corona charger to a reversal position set on the other end side in the longitudinal direction of the grid 10.

When the grid cleaning member 14 reaches the reversal position, a rotational direction of the drive motor 13*b* is reversed to reversely rotate the screw shaft 13*a*, thereby moving the grid cleaning member 14 from the reversal position to the standby position in the longitudinal direction of the grid 10. In this exemplary embodiment, an operation period of time of the drive motor 13*b* from the point of time when the grid cleaning member 14 starts moving from the standby position is measured. When the measured period of time reaches 15 seconds, the rotational direction of the drive motor 13*b* is reversed.

After the grid cleaning member 14 has reached the standby position, the driving of the drive motor 13*b* is stopped to complete the series of cleaning operations. In this exemplary embodiment, an operation period of time of the drive motor 13*b* from the point of time when the rotational direction of the drive motor 13*b* is reversed is measured. When the measured period of time reaches 15 seconds, the rotation of the drive motor 13*b* is stopped. Thus, in this exemplary embodiment, a period of time necessary for reciprocating the grid cleaning member 14 is 30 seconds.

Such a series of driving control operations of the drive motor 13*b* is performed by the motor control unit 302 of the controller 300 that functions as an execution unit illustrated in FIG. 4. Depending on a soiled state of the grid 10, the grid cleaning member 14 may be reciprocated a plurality of times.

The aforementioned cleaning processing (cleaning mode) of the grid 10 is performed each time a main power switch of the image forming apparatus is turned ON or image formation is performed by a predetermined number of times (in this exemplary example, 1000 times). A counter 303 of the controller 300 illustrated in FIG. 4 counts the number of image forming times, and a storage unit (ROM) 304 illustrated in FIG. 4 stores this count data. When the count data of the counter 303 reaches a predetermined value, the motor control unit 302 of the controller 300 operates the drive motor 13*b* to perform cleaning processing of the grid 10. When the cleaning processing of the grid 10 is executed, the counter data stored in the storage unit 304 is reset.

FIG. 4 is a block diagram illustrating a control system of the image forming unit. The image forming unit includes an operation unit 400 operable by a user to perform various setting operations. The controller 300 includes the high voltage control unit 301, the motor control unit 302, the counter 303, the storage unit 304, and an operation unit control unit 305.

Figure 5:
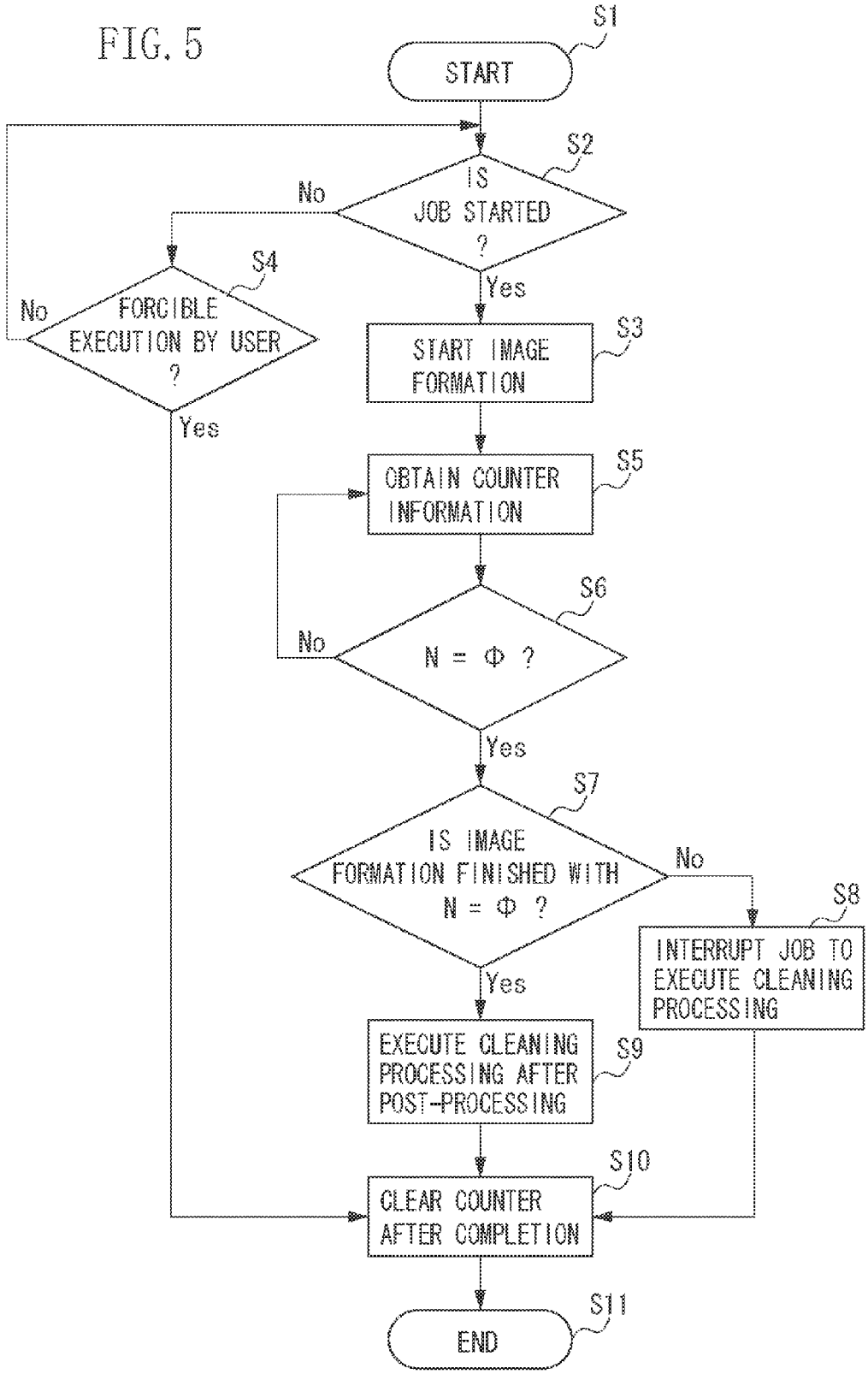
FIG. 5 illustrates a cleaning flow for a grid according to a first exemplary embodiment of the present invention.

FIG. 5 is a flowchart illustrating an execution flow of the cleaning processing (cleaning mode) for the grid 10. The controller 300 controls this cleaning flow for the grid 10. The process will be described below. In the process, jobs mean a series of image formation processing steps based on information of an image input from the PC via the network cable as described above to be output in the image forming apparatus. For example, jobs include various steps such as intermittent printing of one sheet and continuous printing of 100 sheets. In other words, a job start means a start of an image formation processing step, and a job interval means a period from an end of a previous image formation processing step to a start of a next image formation processing step.

In step S1, the image forming apparatus waits for an entry of a signal indicating a job start (standby state). When a signal indicating a job start is input together with image information in step S2, then in step S3, the image forming apparatus starts image formation based on the image information.

In step S5, the counter 303 counts the number of image forming times performed based on the image information to obtain a count value N. A counter value Φ to be compared with the count value N has been stored in the storage unit 304. In step S6, whether the obtained count value N has reached the counter value Φ is determined. If the obtained count value N has not reached the counter value Φ, the processing flow is repeated until the counter value Φ is reached.

When it is determined that the count value N has reached the counter value Φ, then In step S7, whether the job is finished at this point of time is determined. If the job is not finished at this point of time, then in step S8, the job is suspended to perform cleaning processing of the grid 10. In step S10, when this cleaning processing of the grid 10 is finished, the count value N of the counter 303 is cleared (reset) to start remaining image formation. When the remaining image formation is finished without reaching the counter value Φ by the count value N, the series of control operations is completed. In other words, the image forming apparatus is set in a standby state.

If the job is finished at this point of time, then in step S9, in post-processing that is a period from the end of the image formation based on the image information to a rotational stop of the photosensitive member, the cleaning processing of the grid 10 is performed. In this case, similarly, in step S10, when the cleaning processing of the grid 10 is finished, the count value N of the counter 303 is cleared (reset) to complete the series of control operations. In other words, the image forming apparatus is set in a standby state.

In step S4, in the standby state, when the user instructs forcible execution of the cleaning processing of the grid 10 by the operation unit 400, the operation unit control unit 305 executes the cleaning processing of the grid 10. In this case, similarly, in step S10, when the cleaning processing of the grid 10 is finished, the count value N of the counter 303 is cleared (reset) to complete the series of control operations. In other words, the image processing apparatus is set in a standby state.

In this exemplary embodiment, the image forming apparatus is configured to perform the cleaning processing of the grid 10 based on the accumulated number of image forming times (accumulated number of image formed sheets). However, this configuration is in no way limitative. For example, the image forming apparatus may be configured to perform the cleaning processing of the grid 10 based on an accumulated period of charge processing time by the corona charger 2.

In the aforementioned configuration, in the first exemplary embodiment, during the cleaning processing of the grid 10, the grid power source 200 is operated to apply a bias to the grid 10. Specifically, a bias having a polarity equal to a normal charging polarity (negative polarity) of toner is applied from the grid power source 200 to the grid 10.

This bias application is performed for the purpose of electrostatically flying, during the cleaning processing of the inner surface of the grid 10, toner passing behind to the outer surface side of the grid from the mesh openings of the grid 10 to the photosensitive member 1 to clean the outer surface of the grid 10 together with the inner surface.

In this exemplary embodiment, during the cleaning processing of the grid 10, the discharging wire power source 100 is not operated. Hence, no bias is applied to the discharging wire 2*a*.

Figure 7:
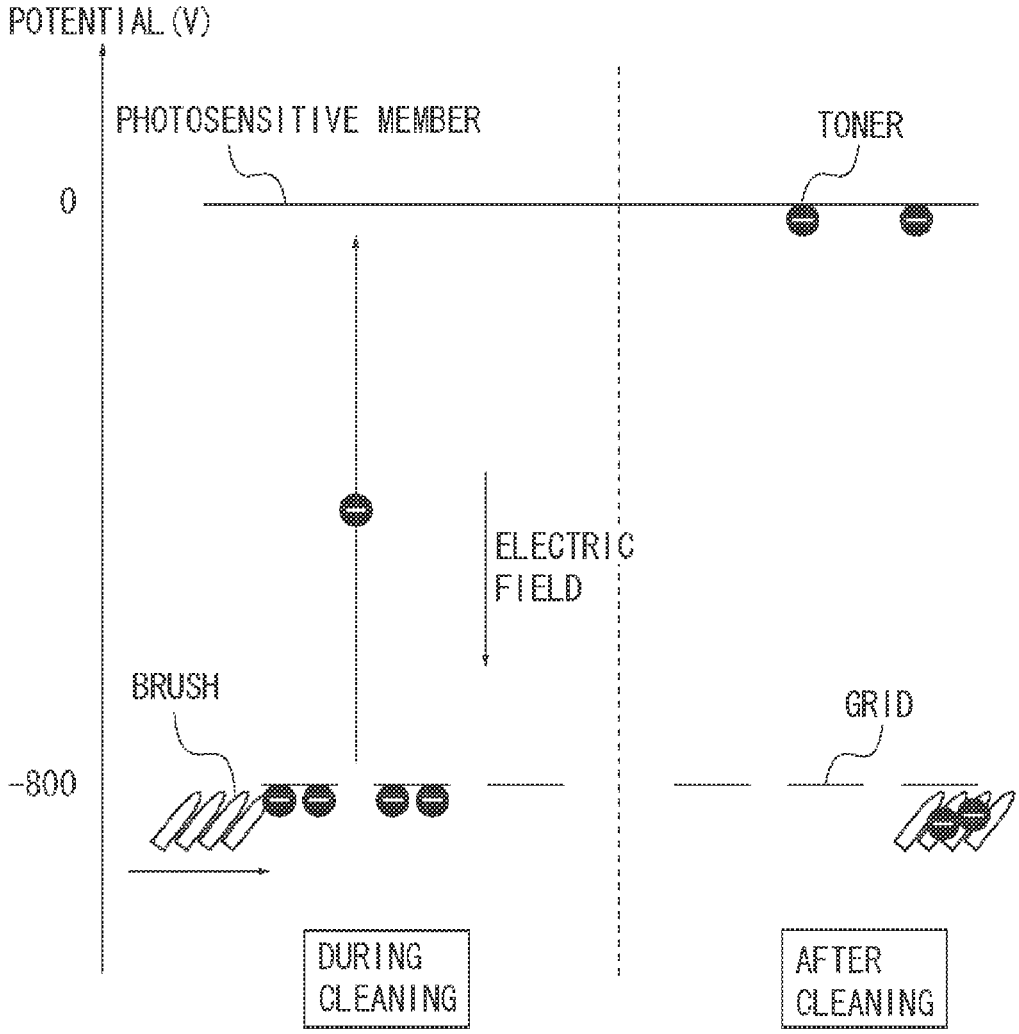
FIG. 7 is a model diagram illustrating a mechanism according to the first exemplary embodiment.

Referring to FIG. 7, a mechanism of flying, when the grid cleaning member 14 cleans the inner surface of the grid 10, the toner passing behind to the outer surface of the grid 10 from the mesh openings of the grid 10 to the photosensitive member 1 will be described. FIG. 7 is a model diagram illustrating a potential relationship between the photosensitive member 1 and the grid 10, a state where the inner surface of the grid 10 is cleaned by a brush that is the grid cleaning member 14, and a state after the cleaning processing.

As illustrated in FIG. 7, during the cleaning processing of the grid 10, the grid power source 200 applies a cleaning bias of −800 V to the grid 10. A surface potential of the photosensitive member 1 is maintained at almost 0 V.

Slide-rubbing with the brush 14 causes a part of toner (negative polarity) stuck to the inner surface of the grid 10 to be captured by the brush 14 while a part passes through the mesh openings of the grid 10 to the photosensitive member 1 side. Conventionally, toner that has passed is kept stuck to the outer surface of grid 10. In this exemplary embodiment, however, the toner can be appropriately removed from the grid 10.

In other words, the toner that has passed from the mesh openings of the grid 10 to the photosensitive member 1 side flies from the grid 10 to the photosensitive member 1 because of an electric field formed between the grid 10 and the photosensitive member 1 by the application of the bias of a negative polarity to the grid 10. Then, the toner that has flown from the grid 10 to the photosensitive member 1 is removed to be recovered by the cleaning device 6 following rotation of the photosensitive member 1. A cleaning bias applied to the grid 10 is not limited to −800 V, but any bias may be applied as long as it enables flying of toner through a gap (about 1 mm) between the grid 10 and the photosensitive member 1.

In this exemplary embodiment, during the cleaning processing, the toner stuck to the grid 10 is friction-charged to a negative polarity so that the toner can fly to the photosensitive member 1 by the electric field formed between the grid 10 and the photosensitive member 1. In other words, a friction-charge sequence of the brush 14 and the grid 10 is set so that the toner stuck to the grid 10 can be friction-charged to a negative polarity.

Figure 6:
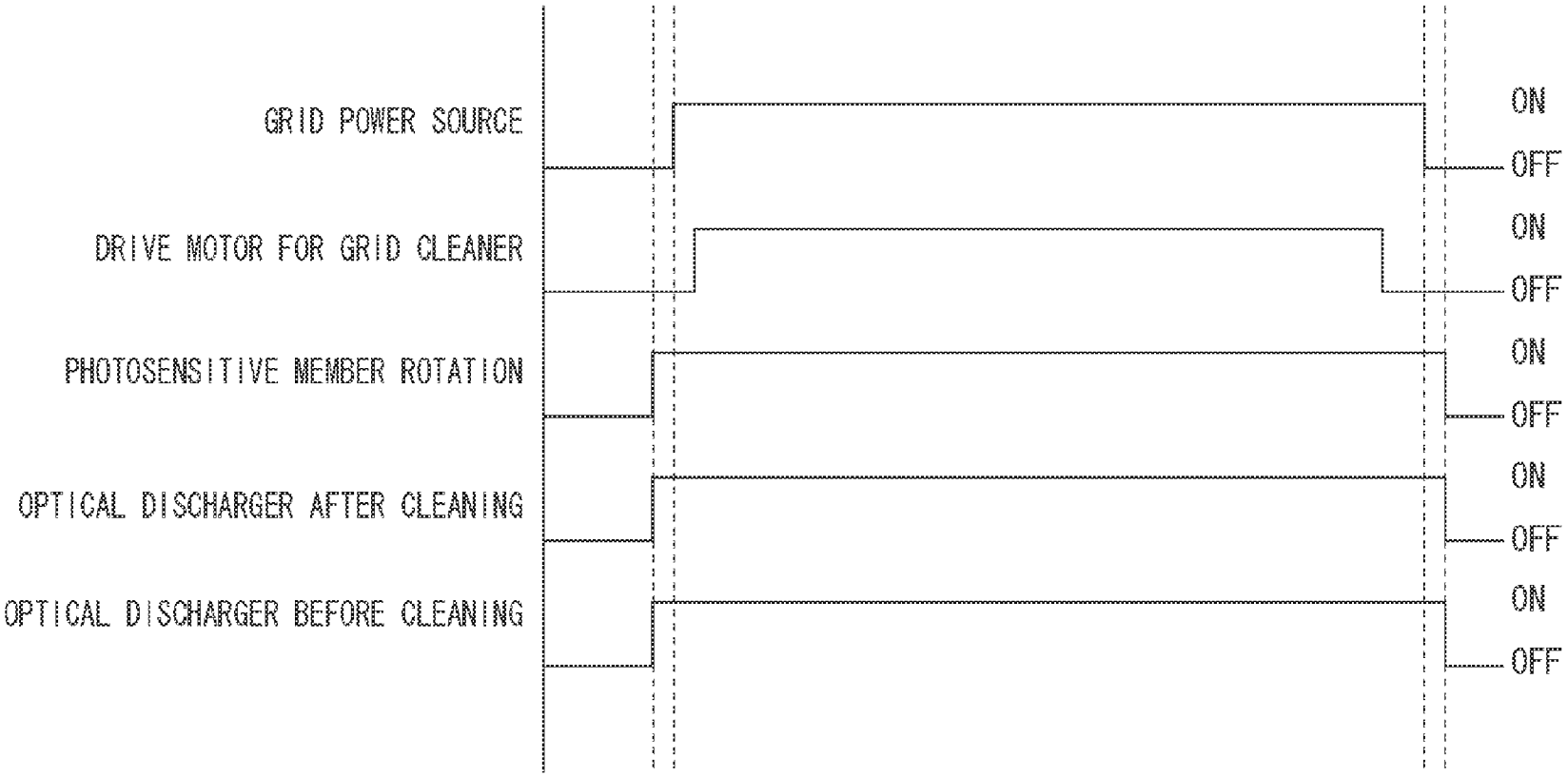
FIG. 6 is a timing chart according to the first exemplary embodiment.

Next, referring to a timing chart of FIG. 6, the grid cleaning processing will be described. The controller 300 performs control so that each device can operate based on the timing chart.

When the drive motor for the photosensitive member stats rotation of the photosensitive member 1, simultaneously, the after-cleaning optical discharging device 8 and the before-cleaning optical discharging device 9 start processing.

At a point of time when a portion of the photosensitive member subjected to the discharging processing reaches a portion (charging position) opposite the corona charger 2, the grid power source applies a cleaning bias to the grid 10.

After the application of the cleaning bias to the grid 10 has been continued for a predetermined period of time, the drive motor 13*b* for the grid cleaning device is operated. As a result, the grid cleaning member 14 is reciprocated in the longitudinal direction of the grid 10.

After completion of the reciprocation of the grid cleaning member 14, the application of the cleaning bias to the grid 10 is stopped. Then, simultaneously with stopping of the rotation of the photosensitive member 1, light irradiation of the after-cleaning optical discharging device 8 and the before-cleaning optical discharging device 9 is stopped (light is turned OFF) to complete the series of cleaning operations.

In this exemplary embodiment, an operation period of time necessary for the cleaning processing is equal to that necessary for reciprocating the grid cleaning member 14, which is about 30 seconds.

In this exemplary embodiment, during the cleaning processing of the grid electrode 10, the photosensitive member 10 is rotated. However, this configuration is in no way limitative. It is because if the photosensitive member 1 has been discharged, the aforementioned "electric field" is sufficiently formed during the cleaning processing of the grid 10. It is also because the step of removing and recovering the toner flown from the grid 10 to the photosensitive member 1 by the cleaning device 6 is automatically executed in a job preprocessing step (preparation step) executed after the cleaning processing.

However, if the toner that has flown to the photosensitive member 1 is maintained as it is, the toner may be scattered for some reason. Hence, the configuration where the photosensitive member 1 is rotated during the cleaning processing of the grid 10 to remove and recover the toner by the cleaning device 6 is more advantageous.

As described above, the optical discharging devices 8 and 9 discharge the photosensitive member 1 before the reciprocation of the grid cleaning member 14. However, if the photosensitive member 1 has been sufficiently discharged before the start of the reciprocation, this discharging step can be omitted. This way, a phenomenon that a photocarrier remains in the photosensitive member 1 following light irradiation of the optical discharging devices 8 and 9 can be prevented.

The inventor conducted verification for cleaning effects when the grid 10 was cleaned while applying a bias to the grid 10 as in the case of the configuration of this exemplary embodiment.

In this exemplary embodiment, the inventor conducted evaluation based on a potential recovery amount of the photosensitive member and an output image density. The inventor used imagePRESSCI (registered trademark) by Canon, Inc., as an image forming apparatus, and conducted a verification experiment under certain environmental conditions (temperature of 23° C. and relative humidity of 5%).

In the verification, as an initial condition, a portion A where toner was forcibly stuck to the inner surface of the grid 10 and a portion B where no toner was stuck were provided, and a potential difference on the photosensitive member 1 corresponding to the portion A and the portion B was set to about 10 V when charging processing was performed in this state. The inventor conducted the verification experiment assuming a worst case where a potential difference of 10 V was generated.

The inventor conducted a durability experiment of continuously forming halftone images (the 48th gray level among 256 gray levels was used) on 5000 sheets of A4 sizes by using the corona charger 2 including the grid 10. In this case, the inventor cleaned the grid 10 for each image formation on every 500 sheets. The inventor measured surface potentials of the photosensitive member corresponding to the portion A and the portion B after the durability experiment of the 5000 sheets. This measurement was performed by using a surface electrometer (Model 1344 by TREK, Inc.) to calculate potential recovery amounts R of the photosensitive member before and after the durability experiment. The inventor conducted evaluation regarding a density difference Δd between halftone images before and after the durability experiment.

As a comparative example, the inventor conducted verification in the case of a conventional configuration where no cleaning bias is applied to the grid.

A potential recovery amount R of the photosensitive member and an image density difference Δd were defined as follows:

$$R=(R_n/R_0)\times 100$$

$$\Delta d=|dn-dn'|$$

R: potential recovery amount (%)

$R_n$: potential (V) of photosensitive member at place corresponding to portion A after durability experiment $R_0$: potential (V) of photosensitive member corresponding to portion A before durability experiment $d_n$: image density at place corresponding to portion B after durability experiment $d_n'$: image density at place corresponding to portion A after durability experiment

TABLE 1

| | Embodiment | Comparative Example |
|---|---|---|
| Cleaning bias to discharging wire | OFF | OFF |
| Cleaning bias | ON | OFF |
| Potential recovery amount R (%) | 84 | 28 |
| Image density difference Δd | 0.06 | 0.15 |

A verification result of Table 1 shows that when a cleaning bias is applied to the grid during cleaning processing of the grid as in the case of this exemplary embodiment, even under such an initial condition that much toner is stuck, a potential recovery amount R of the photosensitive member is high. An image density difference Δd before and after the durability experiment is sufficiently small, providing a satisfactory grid cleaning effect.

On the other hand, in the case of the comparative example where no cleaning bias is applied to the grid during the cleaning processing of the grid, a potential recovery amount R of the photosensitive member is small, and an image density difference Δd before and after the durability experiment is large. The image density difference Δd in the case of the comparative example is deteriorated by a single digit as compared with the case of this exemplary embodiment, and hence unsatisfactory in terms of grid cleaning effect. This unsatisfactory result is due to presence of toner that has passed through the mesh openings of the grid.

As apparent from the foregoing, employing the configuration of this exemplary embodiment enables appropriate cleaning of not only the inner surface of the grid but also the outer surface side facing the photosensitive member. Thus, a charging failure caused by the toner that has passed to the outer surface of the grid can be prevented. As a result, an image density failure accompanying a charging failure can be prevented.

Thus, the toner passing through the mesh openings of the grid electrode to the outer surface during the cleaning processing of the inner surface of the grid electrode can be appropriately removed.

Next, a second exemplary embodiment of the present invention will be described. A basic configuration of an image forming apparatus is as described above.

In this exemplary embodiment, during cleaning processing of a grid 10, not only a grid power source 200 but also a discharging wire power source 100 are operated to apply cleaning biases to the grid 10 and a discharging wire 2*a*. Specifically, the grid power source 200 and the discharging wire power source 100 apply cleaning biases of polarities equal to a normal charging polarity (negative polarity) of toner to the grid 10 and the discharging wire 2*a*. More specifically, a bias of −800 V is applied to the grid 10 under constant voltage control, and a bias of −1000 μA is applied to the discharging wire 2*a* under constant current control.

Figure 9:
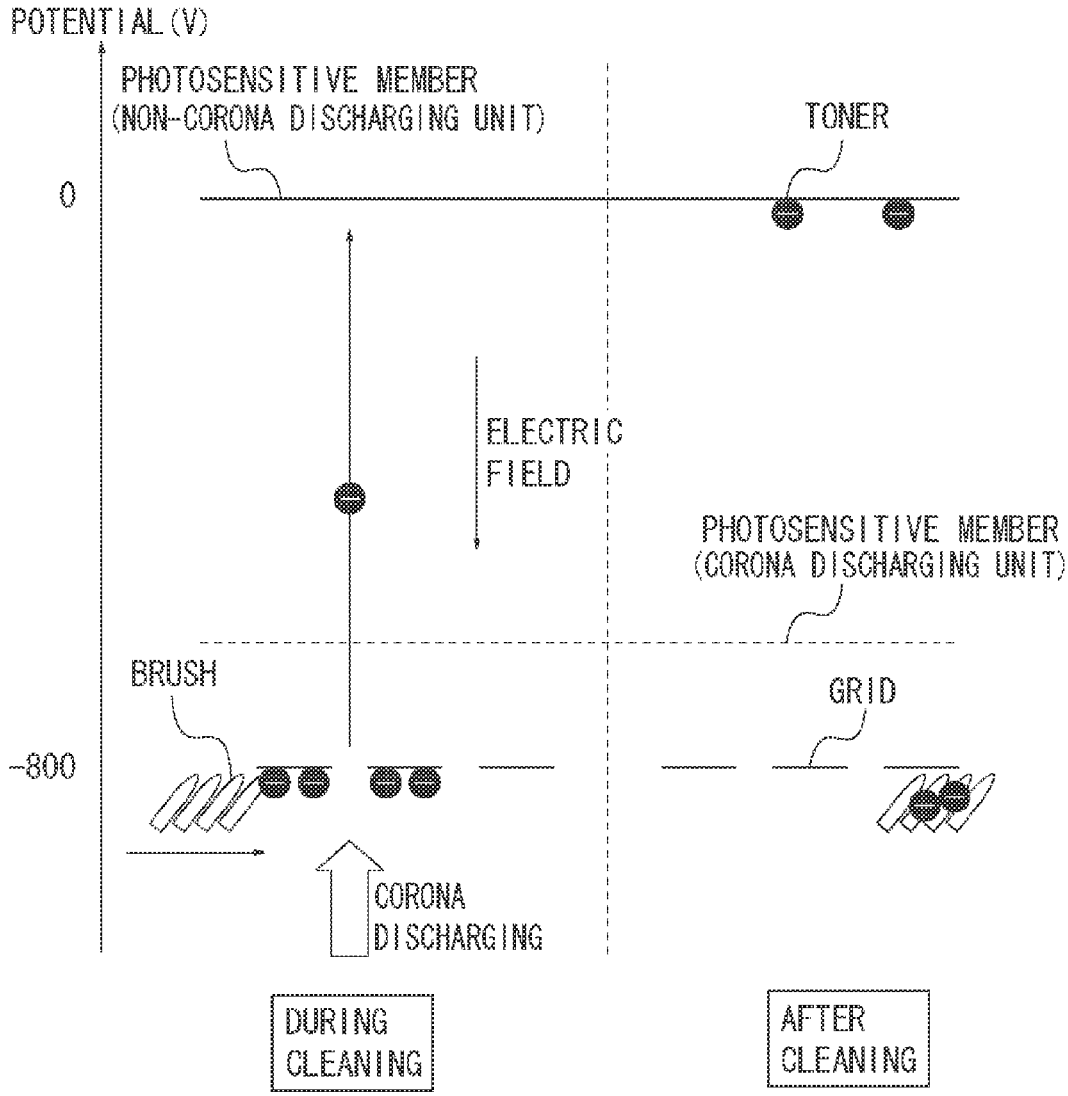
FIG. 9 is a model diagram illustrating a mechanism according to the second exemplary embodiment.

As illustrated in a model diagram of FIG. 9, such biases are applied in order to deal with a case where a charge amount (μC/g) of toner suck to an inner surface of the grid 10 is small or 0 before cleaning. FIG. 9 is a model diagram illustrating a potential relationship between a photosensitive member 1 and the grid 10, a state where the inner surface of the grid 10 is being cleaned by a brush serving as a grid cleaning member 14, and a state after the cleaning. In other words, the purpose is for forcibly charging the toner stuck to the inner surface of the grid 10 to a negative polarity to realize a predetermined charge amount by corona discharging from the discharging wire 2*a*, thereby increasing electrostatic flying efficiency from the grid 10 to the photosensitive member 1.

As a result, any toner stuck to the inner surface of the grid 10 is charged to a negative polarity by corona discharging. Thus, toner passing through mesh openings of the grid 10 sensitively reacts with an electric field formed between the grid 10 and the photosensitive member 1 (non-corona discharged portion: portion that has not been subjected to corona discharging in FIG. 9) to fly to the photosensitive member 1.

In the case of this exemplary embodiment, during the cleaning processing of the grid 10, as in the case of normal image formation, a potential (corona discharged portion that has been subjected to corona discharging in FIG. 9) of the photosensitive member 1 is charged to about −780 V by corona discharging. In other words, a certain portion of the photosensitive member 1 may be charged by corona discharging to reduce an electric field (potential difference) formed to fly the toner.

However, this exemplary embodiment uses blocking of corona discharging directed to the photosensitive member 1 by the grid cleaning member 14 set in an electrically insulated state. In other words, a potential is kept 0 in the portion of the photosensitive member (non-corona discharged portion in FIG. 9) directly below the grid cleaning member 14, and toner flies to this 0 potential portion.

The above situation occurs because of a configuration where the photosensitive member 1 is rotated during the cleaning processing of the grid 10, and surfaces of the photosensitive member 1 having their surface potentials set to about 0 by optical discharging devices 8 and 9 arrive one after another below a corona charger. In this case, if the cleaning processing of the grid 10 is performed for a long period of time by waiting for attenuation of the surface potential of the photosensitive member to about 0 V, the discharging processing of the optical discharging devices 8 and 9 is not always necessary. However, during the cleaning processing of the grid 10, a downtime period is set where normal image formation is inhibited, which is extremely inconvenient for a user who wises to form an image early.

From this viewpoint, the cleaning processing of the grid 10 should preferably be completed within a short period of time, and the configuration of this exemplary embodiment where the discharging processing is performed by the optical discharging devices 8 and 9 during the cleaning processing of the grid 10 is more advantageous.

Figure 10:
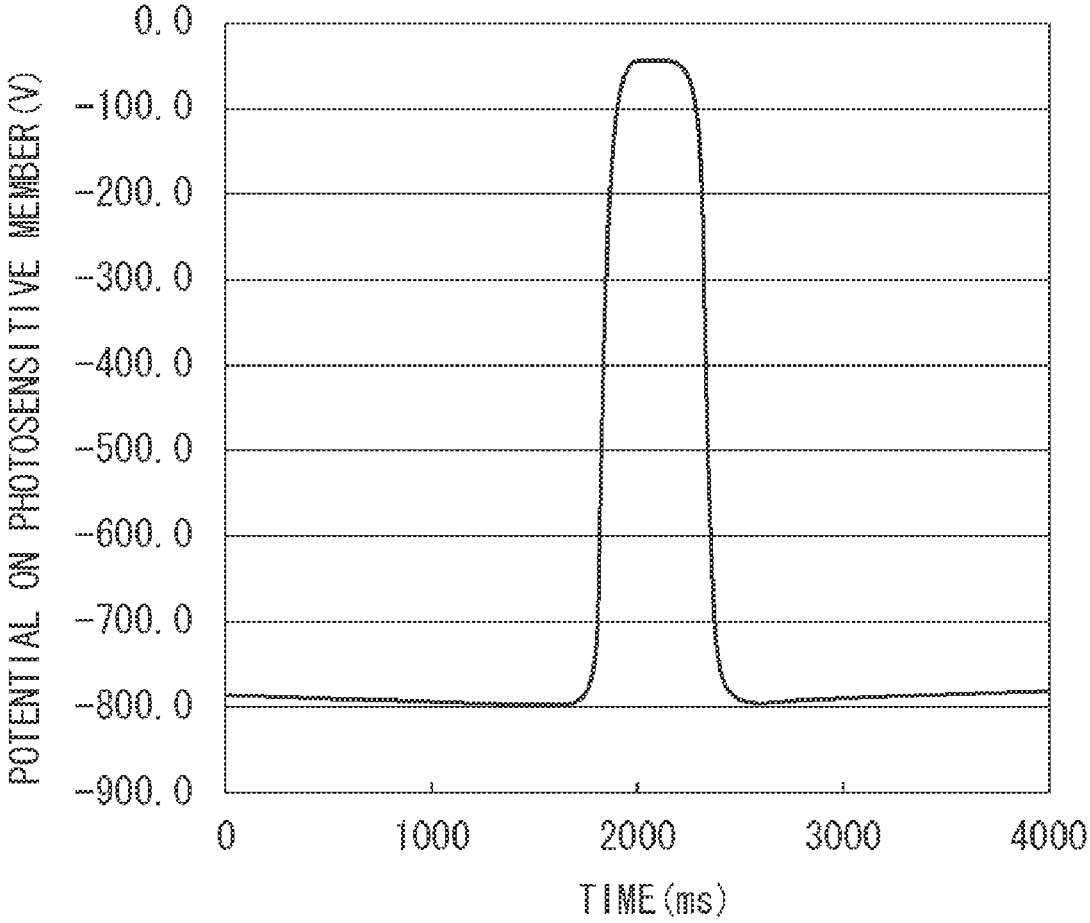
FIG. 10 illustrates a potential change of a photosensitive member according to the second exemplary embodiment.

FIG. 10 illustrates such a state. In FIG. 10, a vertical axis indicates a potential of the photosensitive member, while a horizontal axis indicates time. Specifically, FIG. 10 illustrates a case where a surface potential at a fixed point of the photosensitive member is measured, and the potential changes with a passage of time.

In other words, a period where a surface potential of the photosensitive member becomes almost 0 V (period of about 250 ms after abut 1.9 seconds from a measuring start in this exemplary embodiment) is present, which corresponds to a period where corona discharging is blocked by the grid cleaning member 14).

Figure 8:
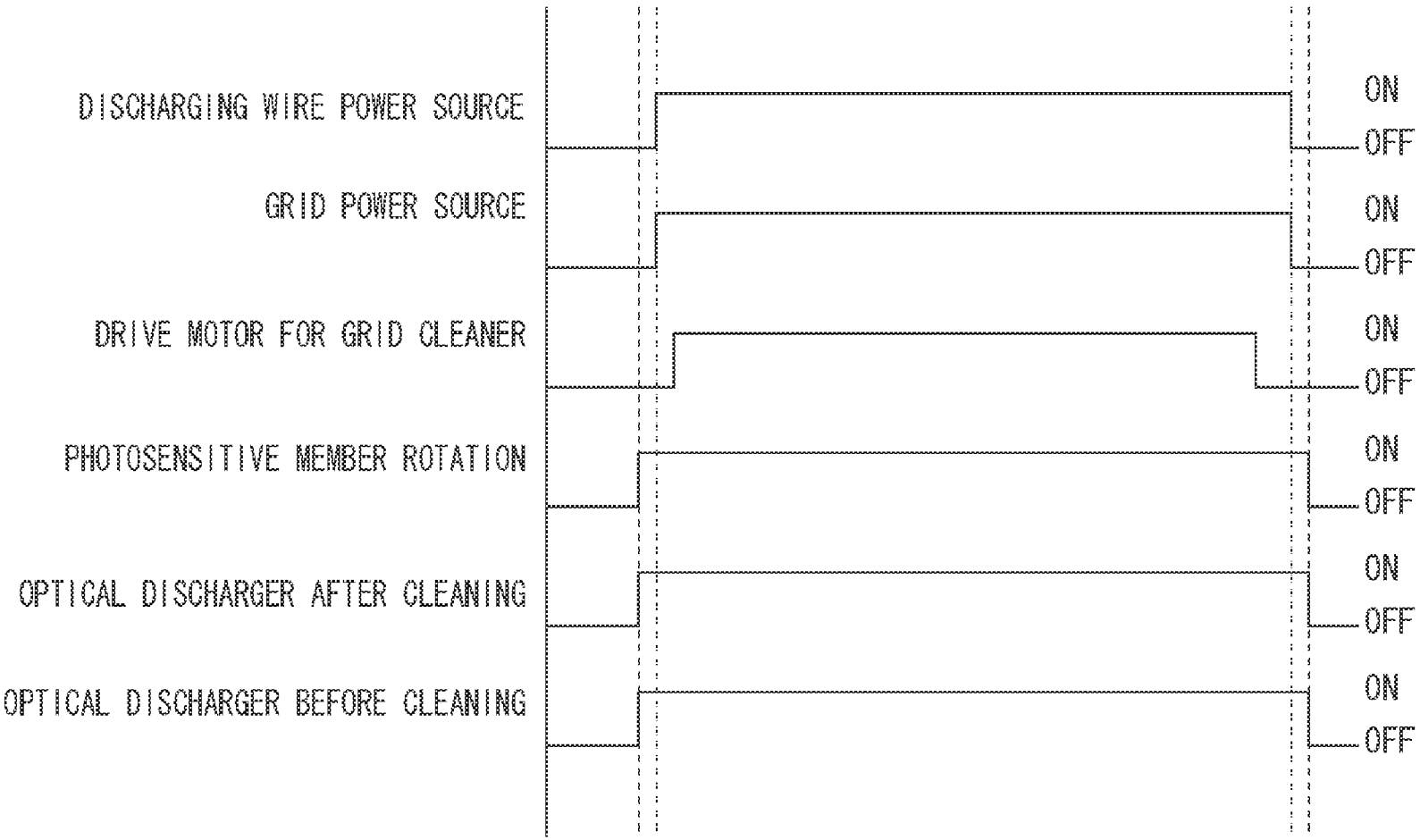
FIG. 8 is a timing chart according to a second exemplary embodiment of the present invention.

Next, referring to a timing chart of FIG. 8, the grid cleaning processing will be described. A controller 300 performs control so as to operate each device based on the timing chart.

When a photosensitive drive motor starts rotation of the photosensitive member 1, simultaneously, the after-cleaning optical discharging device 8 and the before-cleaning optical discharging device 9 start discharging.

At a point of time when a portion of the photosensitive member subjected to the discharging processing reaches a portion (charging position) opposite the corona charger 2, the grid power source 200 applies a cleaning bias to the grid 10, and the discharging wire power source 100 applies a cleaning bias to the discharging wire 2*a*.

After the application of the cleaning biases to the grid 10 and the discharging wire 2*a* has been continued for a predetermined period of time, a drive motor 13*b* for the grid cleaning device is operated. As a result, the grid cleaning member 14 is reciprocated in a longitudinal direction of the grid 10.

After completion of the reciprocation of the grid cleaning member 14, the application of the cleaning biases to the grid 10 and the discharging wire 2*a* is stopped. Then, simultaneously with stopping of the rotation of the photosensitive member 1, light irradiation of the after-cleaning optical discharging device 8 and the before-cleaning optical discharging device 9 is stopped (light is turned OFF) to complete the series of cleaning operations.

In this exemplary embodiment, an operation period of time necessary for the cleaning processing is equal to that necessary for reciprocating the grid cleaning member 14, which is about 30 seconds.

The inventor conducted verification for cleaning effects when the grid 10 was cleaned while applying cleaning biases to the grid 10 and the discharging wire 2*a* as in the case of the configuration of this exemplary embodiment.

Conditions for a verification experiment are similar to those of the first exemplary embodiment. For reference, the comparative example of the first exemplary embodiment will be described.

TABLE 2

| | Embodiment | Comparative Example |
|---|---|---|
| Cleaning bias to discharging wire | ON | OFF |
| Cleaning bias | ON | OFF |
| Potential recovery amount R (%) | 95 | 28 |
| Image density difference Δd | 0.02 | 0.15 |

A verification result of Table 2 shows that when cleaning biases are applied to the grid and the discharging wire during cleaning processing of the grid as in the case of this exemplary embodiment, even under such an initial condition that much toner is stuck, a potential recovery amount R of the photosensitive member is higher than that of the first exemplary embodiment. An image density difference Δd before and after a durability experiment is smaller than that of the first exemplary embodiment, providing a satisfactory grid cleaning effect.

As apparent from the foregoing, employing the configuration of this exemplary embodiment enables more appropriate cleaning of not only the inner surface of the grid but also the outer surface side facing the photosensitive member. Thus, a charging failure caused by toner that has passed to the outer surface of the grid can be prevented. As a result, an image density failure accompanying a charging failure can be prevented.

The configuration of this exemplary embodiment can be an effective solution when there is no or only a limited function, if any, of friction-charging toner to a negative polarity during the cleaning processing of the grid.

Next, a third exemplary embodiment of the present invention will be described. A basic configuration of an image forming apparatus is as described above.

In this exemplary embodiment, during cleaning processing of a grid 10, not a grid power source 200 but a discharging wire power source 100 is operated to apply a cleaning bias to a discharging wire 2*a*. Specifically, the discharging wire power source 100 applies a cleaning bias of a polarity equal to a normal charging polarity (negative polarity) of toner to the discharging wire 2*a*. More specifically, a bias of −1000 μA is applied to the discharging wire 2*a* under constant current control. During the cleaning processing of the grid 10, bias application to the grid 10 is switched OFF. In this case, the grid 10 is not grounded but electrically set in a floating state.

In this exemplary embodiment, in order to provide a function of forming an electric field for flying toner to a photosensitive member 1 between the grid 10 and the photosensitive member 1 and a function of forcibly charging the toner to a negative polarity, the cleaning bias is applied to the discharging wire 2*a*.

Figure 11:
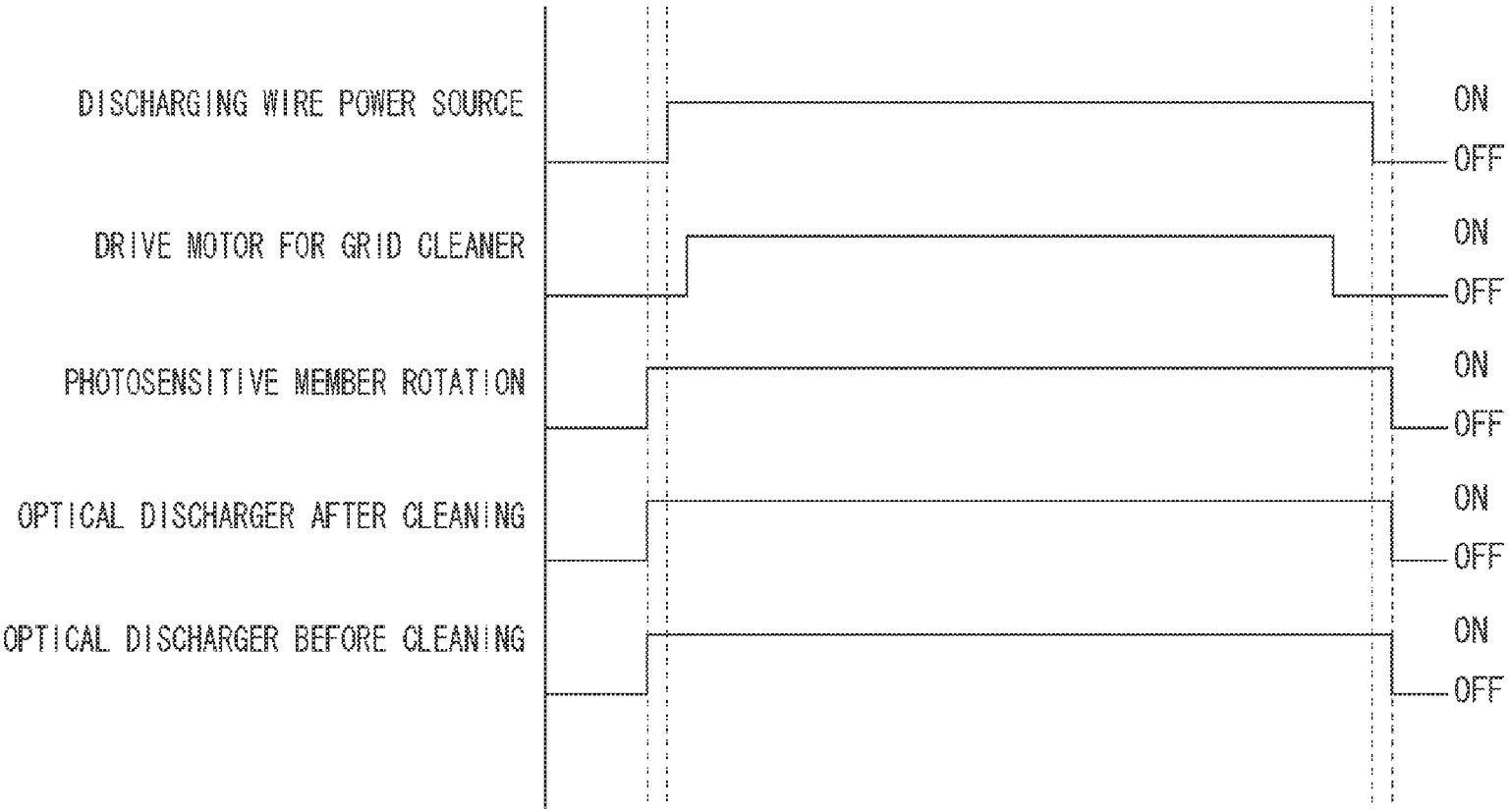
FIG. 11 is a timing chart according to a third exemplary embodiment of the present invention.
Figure 12:
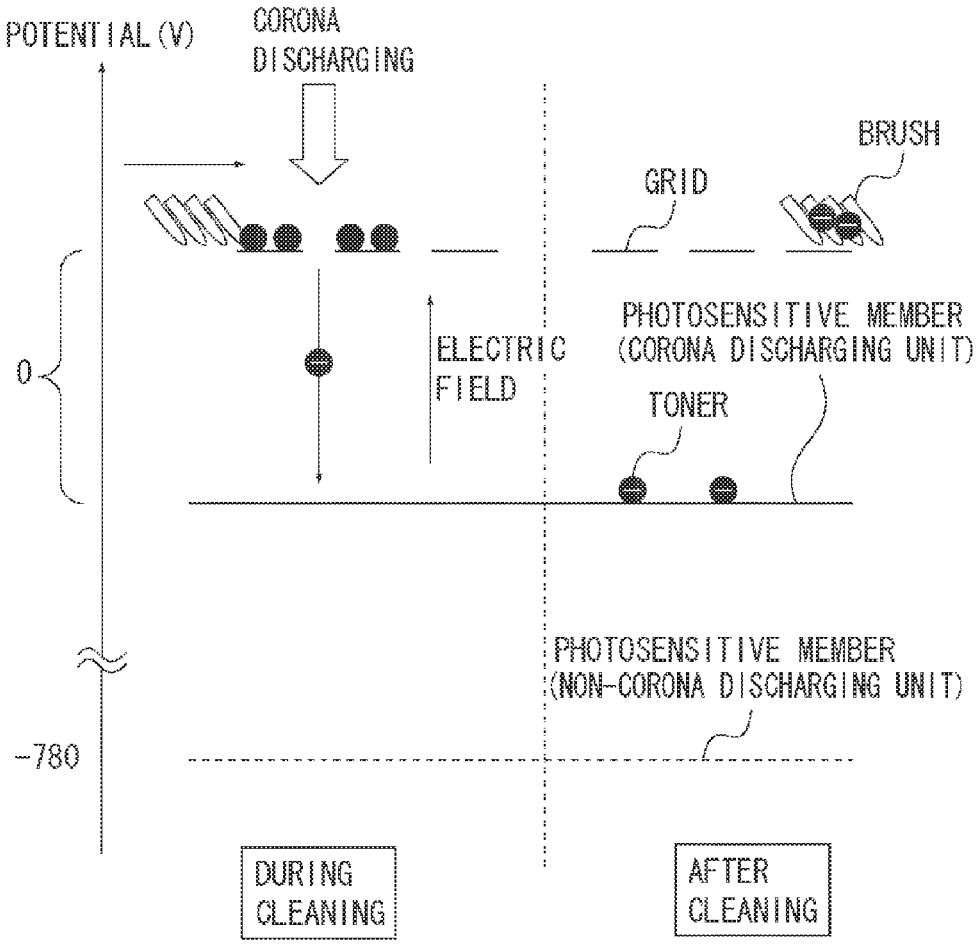
FIG. 12 is a model diagram illustrating a mechanism according to the third exemplary embodiment.

Next, referring to a timing chart of FIG. 11, the grid cleaning processing will be described. A controller 300 performs control so as to operate each device based on the timing chart.

When a photosensitive drive motor starts rotation of the photosensitive member 1, simultaneously, an after-cleaning optical discharging device 8 and a before-cleaning optical discharging device 9 start discharging.

At a point of time when a portion of the photosensitive member subjected to the discharging processing reaches a portion (charging position) opposite a corona charger 2, the discharging wire power source 100 applies a cleaning bias to the discharging wire 2*a*.

After the application of the cleaning bias to the discharging wire 2*a* has been continued for a predetermined period of time, a drive motor 13*b* for a grid cleaning device is operated. As a result, a grid cleaning member 14 is reciprocated in a longitudinal direction of the grid 10.

After completion of the reciprocation of the grid cleaning member 14, the application of the cleaning bias to the discharging wire 2*a* is stopped. Then, simultaneously with stopping of the rotation of the photosensitive member 1, light irradiation of the after-cleaning optical discharging device 8 and the before-cleaning optical discharging device 9 is stopped (light is turned OFF) to complete the series of cleaning operations. In this exemplary embodiment, an operation period of time necessary for the cleaning processing is equal to that necessary for reciprocating the grid cleaning member 14, which is about 30 seconds.

The inventor conducted verification for cleaning effects when the grid 10 was cleaned while applying a cleaning bias only to the discharging wire 2*a* as in the case of the configuration of this exemplary embodiment.

Conditions for a verification experiment are similar to those of the first exemplary embodiment. For reference, the comparative example of the first exemplary embodiment will be described.

TABLE 3

| | Embodiment | Comparative Example |
|---|---|---|
| Cleaning bias to discharging wire | ON | OFF |
| Cleaning bias | OFF | OFF |
| Potential recovery amount R (%) | 80 | 28 |
| Image density difference Δd | 0.05 | 0.15 |

A verification result of Table 3 shows that when a cleaning bias is applied to the discharging wire during cleaning processing of the grid as in the case of this exemplary embodiment, even under such an initial condition that much toner is stuck, a potential recovery amount R of the photosensitive member is higher than that of the comparative example. An image density difference Δd before and after a durability experiment is sufficiently smaller than that of the comparative example, providing a satisfactory grid cleaning effect.

As apparent from the foregoing, employing the configuration of this exemplary embodiment enables more appropriate cleaning of not only the inner surface of the grid but also the outer surface side facing the photosensitive member. Thus, a charging failure caused by toner that has passed to the outer surface of the grid can be prevented. As a result, an image density failure accompanying a charging failure can be prevented.

The configuration of this exemplary embodiment can be an effective solution when there is no or only a limited function, if any, of friction-charging toner to a negative polarity during the cleaning processing of the grid. Cleaning bias application to the grid can be omitted, and hence power consumption accompanying the cleaning processing of the grid can be reduced more as compared with the configuration of the second exemplary embodiment.

Next, a fourth exemplary embodiment of the present invention will be described. A basic configuration of an image forming apparatus is as described above except for an air flow mechanism.

Figure 13:
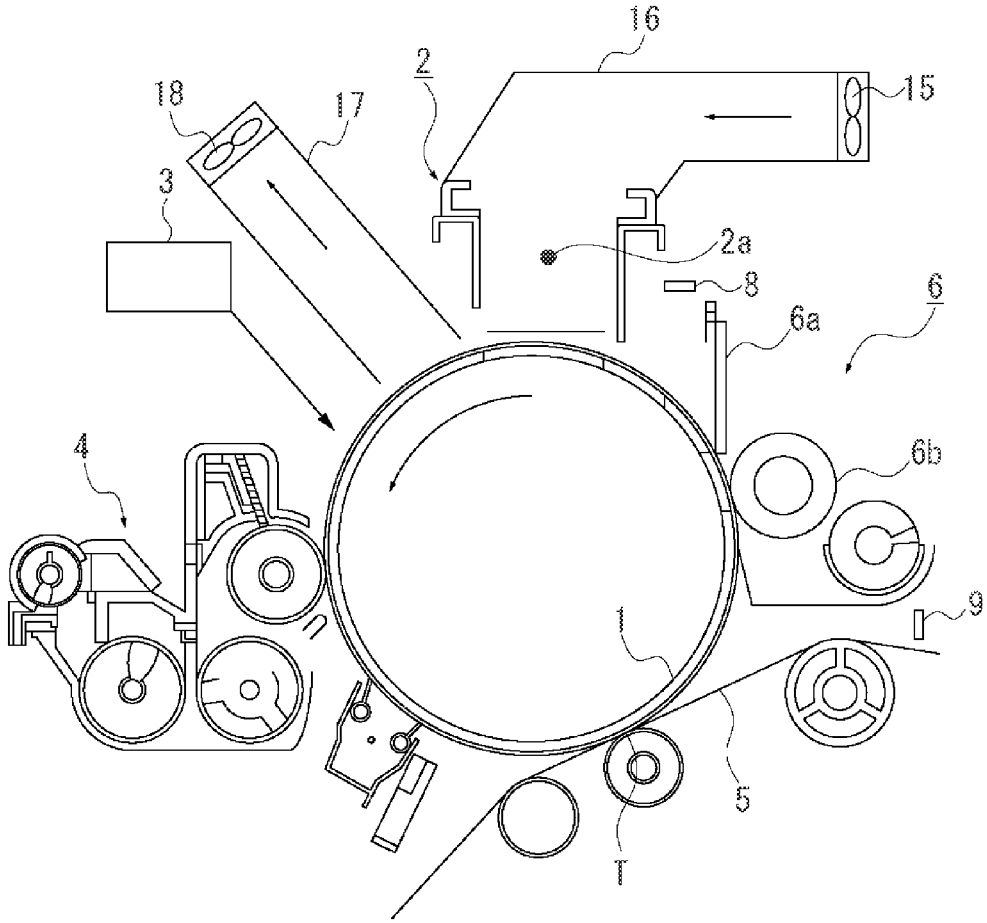
FIG. 13 is a schematic sectional diagram illustrating an image forming unit that includes an air flow mechanism according to a fourth exemplary embodiment of the present invention.

FIG. 13 is a schematic sectional diagram of the image forming apparatus. A difference from FIG. 1 is addition of the air flow mechanism to form an air flow in a shield of a corona charger 2. Other components are similar, and hence description of these other components will be omitted.

In this exemplary embodiment, the air flow is formed in the shield of the corona charger 2 to prevent re-sticking, to a grid 10, of toner that has passed from an inner surface of the grid 10 to a discharging wire 2*a* side during cleaning processing of the grid 10. This configuration is different from those of the first to third exemplary embodiments. For cleaning bias application during the cleaning processing of the grid 10, the configurations of the first to third exemplary embodiments can be similarly applied. Hereinafter, an example to which the configuration of the second exemplary embodiment is applied will be described.

As illustrated in FIG. 13, the air flow mechanism of this exemplary embodiment includes an intake fan 15 as a suction unit, and a suction duct 16 configured to guide air sucked by the intake fan 15 into the shield. The air flow mechanism further includes an exhaust duct 17 configured to discharge the air from the shield, and an exhaust fan 18 as an exhaust unit.

This air flow mechanism supplies air sucked by the intake fan 15 into the shield of the corona charger 2 via the suction duct 16 located directly above the corona charger 2. The air supplying into the shield is performed so as to be almost uniform in a longitudinal direction of the corona charger 2. A filter is disposed in an air supplying position of the intake fan 15 to prevent mixing of any foreign objects in the shield from the outside.

Then, the exhaust fan 18 discharges the air via the exhaust duct 17 located on a photosensitive member moving direction downstream side of the corona charger 2. A filter is disposed in an air intake side position of the exhaust fan 18 to capture toner.

Thus, toner that has passed during the cleaning processing of the grid 10 can be removed from the shield. The air flow mechanism also functions as an air curtain to prevent incursion of foreign objects into the shield from around the corona charger 2. Hence, the function of the grid 10 can be maintained for a long period of time.

Figure 14:
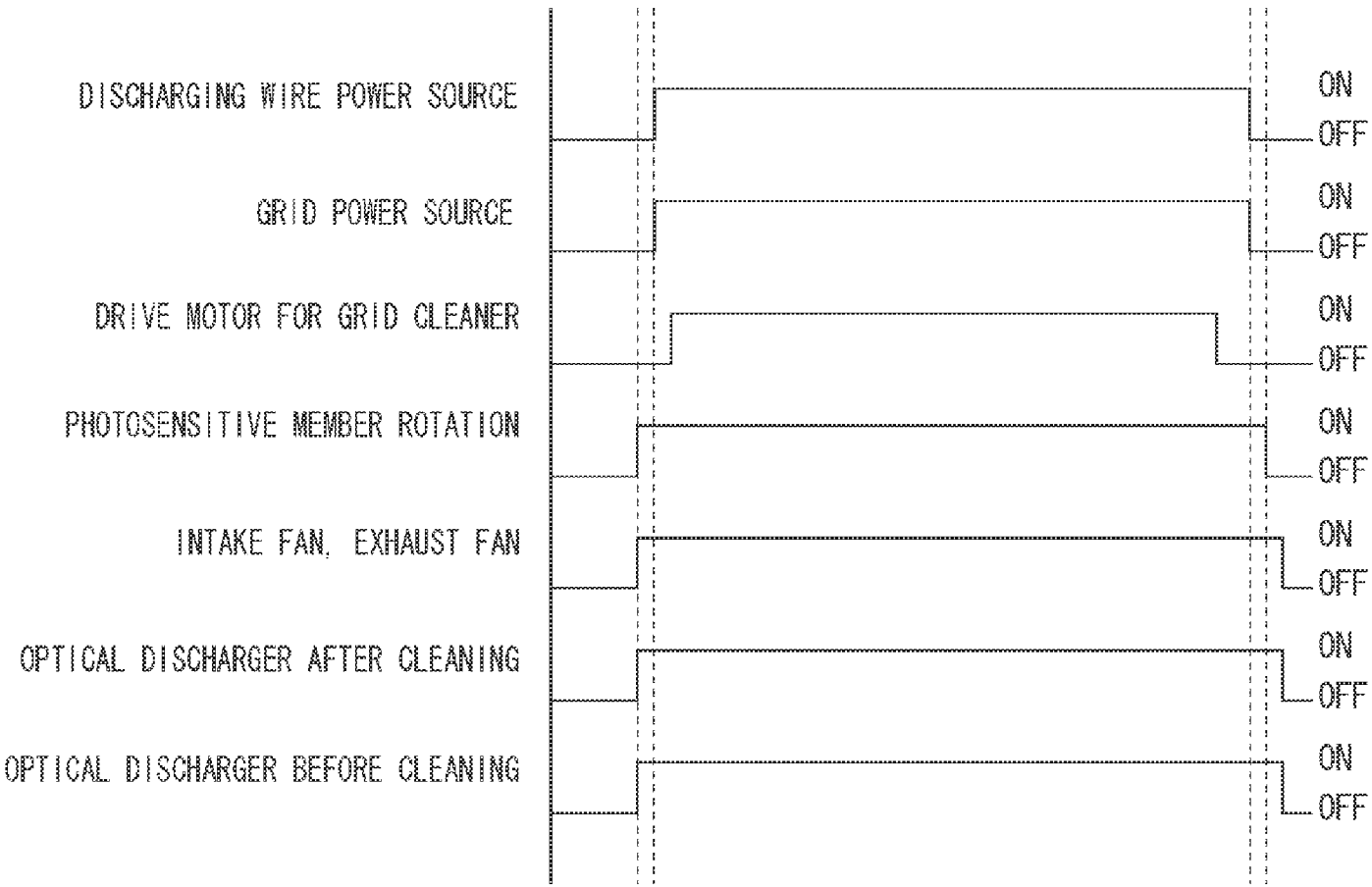
FIG. 14 is a timing chart according to the fourth exemplary embodiment.

Next, referring to a timing chart of FIG. 14, the grid cleaning processing will be described. A controller 300 performs control so as to operate each device based on the timing chart.

When a photosensitive drive motor starts rotation of the photosensitive member 1, simultaneously, an after-cleaning optical discharging device 8 and a before-cleaning optical discharging device 9 start discharging. At this point of time, the intake fan 15 and the exhaust fan 18 are operated. In this exemplary embodiment, a wind velocity into the shield of the corona charger 2 is set to 0.75 m/s.

At a point of time when a portion of the photosensitive member subjected to the discharging processing reaches a portion (charging position) opposite the corona charger 2, a grid power source 200 applies a cleaning bias to the grid 10, and a discharging wire power source 100 applies a cleaning bias to the discharging wire 2*a*.

After the application of the cleaning biases to the grid 10 and the discharging wire 2*a* has been continued for a predetermined period of time, a drive motor 13*b* for a grid cleaning device is operated. As a result, the grid cleaning member 14 is reciprocated in a longitudinal direction of the grid 10.

After completion of the reciprocation of the grid cleaning member 14, the application of the cleaning biases to the grid 10 and the discharging wire 2*a* is stopped. Then, after stopping of the rotation of the photosensitive member 1, light irradiation of the after-cleaning optical discharging device 8 and the before-cleaning optical discharging device 9 is stopped (light is turned OFF), and the intake fan 15 and the exhaust fan 18 are stopped to complete the series of cleaning operations.

In this exemplary embodiment, an operation period of time necessary for the cleaning processing is equal to that necessary for reciprocating the grid cleaning member 14, which is about 30 seconds.

As apparent from the foregoing, employing the configuration of this exemplary embodiment enables prevention of re-sticking, to the gird, of toner that has passed during the cleaning processing of the grid. Thus, the grid can be cleaned more appropriately.

Next, a fifth exemplary embodiment of the present invention will be described. A basic configuration of an image forming apparatus is as described above except for inclusion of an air flow mechanism and a cleaning mechanism of a discharging wire 2*a*, and hence repeated description will be avoided. The air flow mechanism of this exemplary embodiment is similar to that of the fourth exemplary embodiment, and hence repeated description will be avoided.

This configuration (air flow mechanism and cleaning mechanism of discharging wire 2*a*) is different from those of the first to third exemplary embodiments. For cleaning bias application during cleaning processing of a grid 10, the configurations of the first to third exemplary embodiments can be similarly applied. Hereinafter, an example to which the configuration of the second exemplary embodiment is applied will be described.

Figure 16:
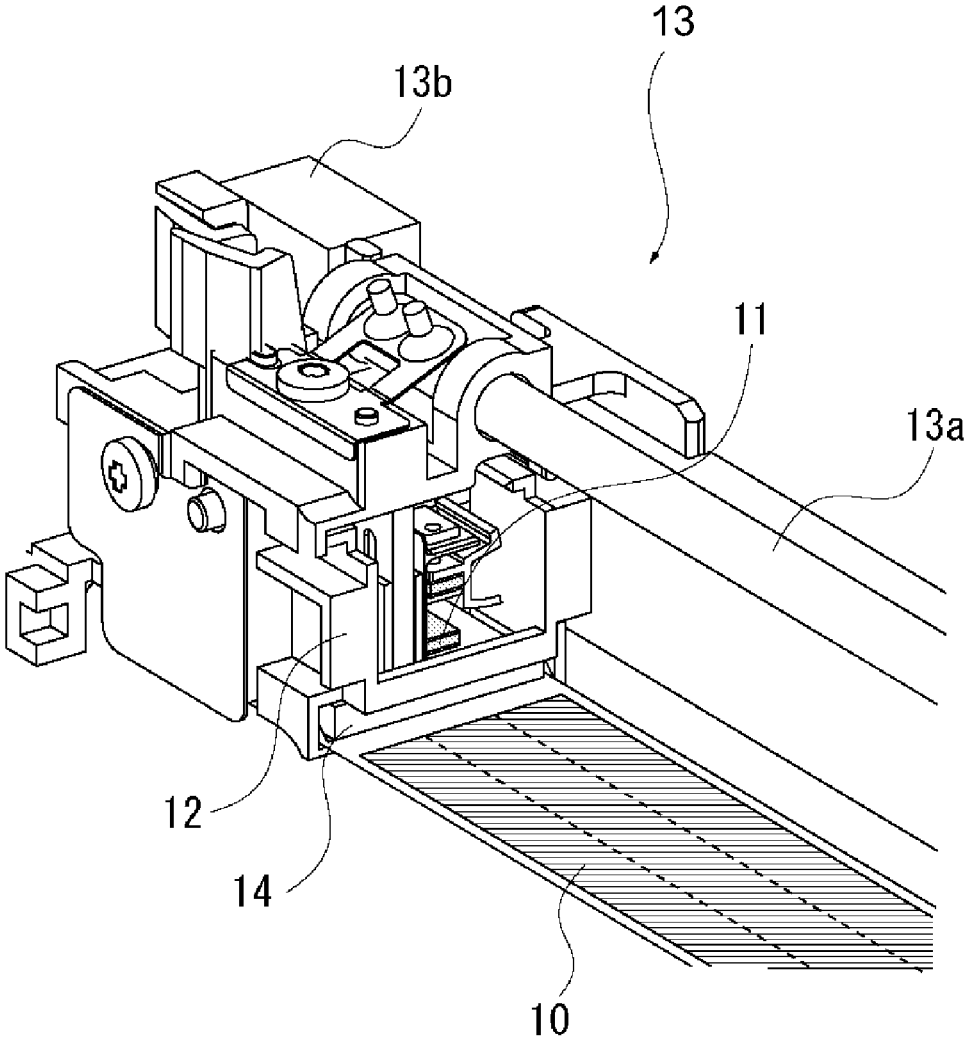
FIG. 16 is a schematic perspective diagram illustrating a charging device according to the fifth exemplary embodiment.

As illustrated in FIG. 16, a wire cleaning member 11 is disposed to clean the discharging wire 2*a*. This wire cleaning member 11 is configured to reciprocate integrally with a grid cleaning member 14. Specifically, as in the case of the grid cleaning member 14, the wire cleaning member 11 is fixed to a cleaning support 12. Thus, as in the case of the grid cleaning member 14, when a drive motor 13*b* is operated, a screw shaft 13*a* is rotated to reciprocate the wire cleaning member 11 integrally with the grid cleaning member 14.

In this exemplary embodiment, the image forming apparatus includes a pair of wire cleaning members 11 prepared by using sponges as base materials, forming rubber layers on surface layers, and coating the surface lasers with alumina serving as polishing particles. In other words, the surface layers coated with the alumina are pressed into contact with each other to hold the discharging wire 2*a* therebetween. In this state, reciprocating the wire cleaning members 11 in a longitudinal direction of the discharging wire 2*a* enables removal of foreign objects such as toner stuck to the discharging wire 2*a*.

Figure 15:
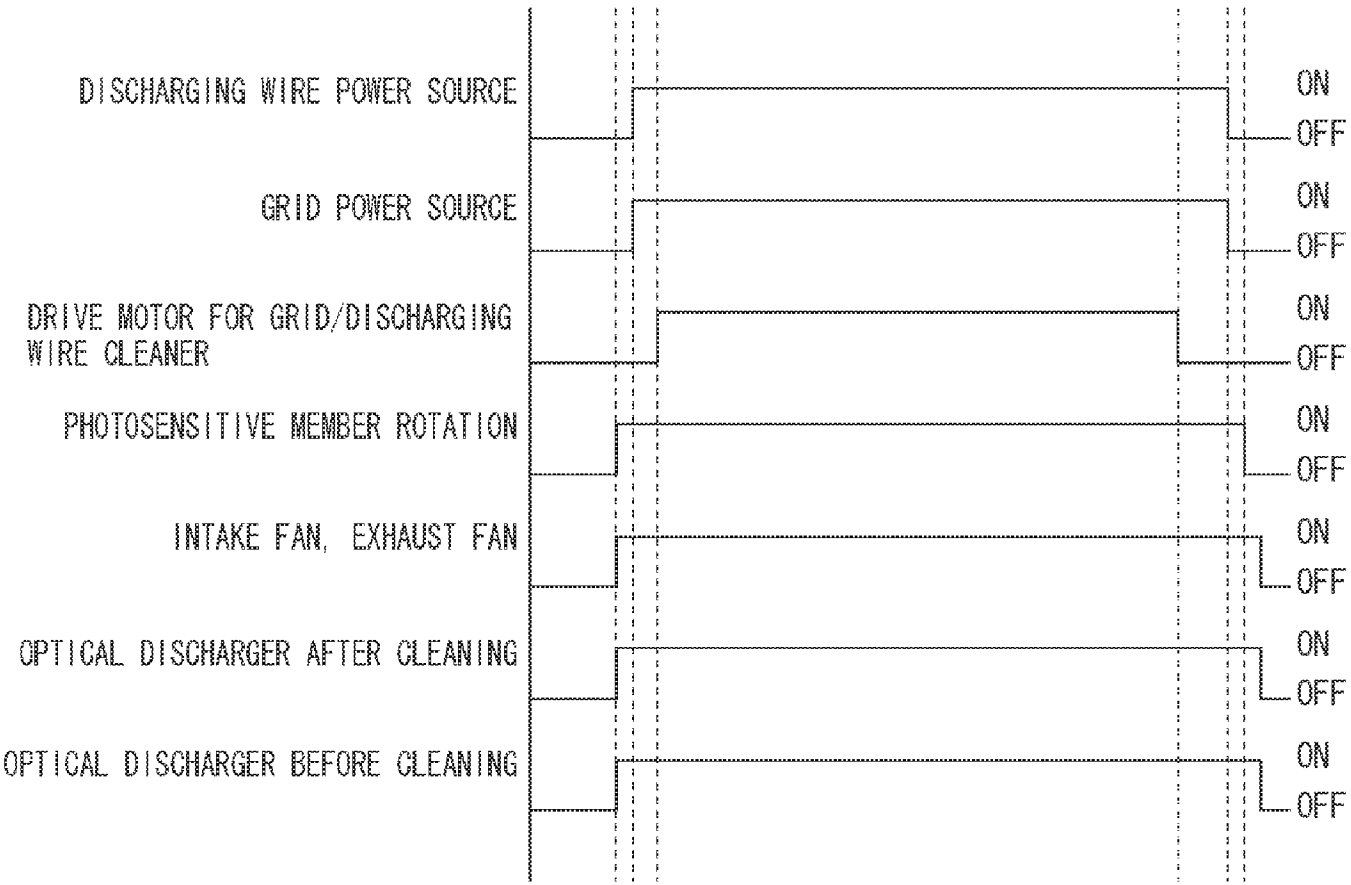
FIG. 15 is a timing chart according to a fifth exemplary embodiment of the present invention.

Next, referring to a timing chart of FIG. 15, the grid/wire cleaning processing will be described. A controller 300 performs control so as to operate each device based on the timing chart.

When a photosensitive drive motor starts rotation of a photosensitive member 1, simultaneously, an after-cleaning optical discharging device 8 and a before-cleaning optical discharging device 9 start discharging. At this point of time, an intake fan 15 and an exhaust fan 18 are operated. In this exemplary embodiment, a wind velocity into a shield of a corona charger 2 is set to 0.75 m/s.

At a point of time when a portion of the photosensitive member subjected to the discharging processing reaches a portion (charging position) opposite the corona charger 2, a grid power source 200 applies a cleaning bias to the grid 10, and a discharging wire power source 100 applies a cleaning bias to the discharging wire 2*a*.

After the application of the cleaning biases to the grid 10 and the discharging wire 2*a* has been continued for a predetermined period of time, a drive motor 13*b* for a grid cleaning device is operated. As a result, the grid cleaning member 14 and the wire cleaning member 11 are reciprocated in the longitudinal directions of the grid 10 and the discharging wire 2*a*.

After completion of the reciprocation of the grid cleaning member 14 and the discharging wire 2*a*, the application of the cleaning biases to the grid 10 and the discharging wire 2*a* is stopped. Then, after stopping of the rotation of the photosensitive member 1, light irradiation of the after-cleaning optical discharging device 8 and the before-cleaning optical discharging device 9 is stopped (light is turned OFF), and the intake fan 15 and the exhaust fan 18 are stopped to complete the series of cleaning operations.

As apparent from the foregoing, employing the configuration of this exemplary embodiment enables prevention of transfer (sticking), to the discharging wire 2*a*, of toner that passes and flies in the shield during the cleaning processing of the grid 10 due to the wire cleaning member 11 and the air flow.

The first to fifth exemplary embodiments have been described by way of example where the corona charger uniformly charges the photosensitive member. However, the image forming apparatus is not limited to this use.

For example, the image forming apparatus can be similarly applied to the corona charger that charges a toner image formed on the photosensitive member by the developing device before its transfer. The image forming apparatus can be similarly applied to the corona charger that charges toner remaining on the photosensitive member after the transfer.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2008-328014 filed Dec. 24, 2009, which is hereby incorporated by reference herein in its entirety.

What is claimed is:

1. An image forming apparatus comprising:

a photosensitive member configured to form a toner image thereon;

a corona charger located opposite the photosensitive member and including a discharging wire and a grid electrode;

a bias applying unit configured to apply a bias to the corona charger;

a cleaning unit configured to perform cleaning processing by sliding in longitudinal direction of the grid electrode to rub an inner surface of the grid electrode;

an execution unit configured to execute a cleaning mode for performing the cleaning processing by the cleaning unit while applying a bias of a polarity equal to a normal charging polarity of toner to the grid electrode by the bias applying unit; and a light irradiation unit configured to irradiate the photosensitive member with light to remove an electrostatic image remaining on the photosensitive member, wherein the execution unit causes the light irradiation unit to operate during the cleaning mode.

2. An image forming apparatus comprising:

a photosensitive member configured to form a toner image thereon;

a corona charger located opposite the photosensitive member and including a discharging wire and a grid electrode;

a bias applying unit configured to apply a bias to the corona charger;

a cleaning unit configured to perform cleaning processing by sliding in a longitudinal direction of the grid electrode to rub an inner surface of the grid electrode; and an execution unit configured to execute a cleaning mode for performing the cleaning processing by the cleaning unit while rotating the photosensitive member and applying a bias of a polarity equal to a normal charging polarity of toner to the discharging wire by the bias applying unit.

3. An image forming apparatus comprising:

a photosensitive member configured to form a toner image thereon;

a corona charger located opposite the photosensitive member and including a discharging wire and a grid electrode;

a bias applying unit configured to apply a bias to the corona charger;

a cleaning unit configured to perform cleaning processing by sliding in a longitudinal direction of the grid electrode to rub an inner surface of the grid electrode; and an execution unit configured to execute a cleaning mode for performing the cleaning processing by the cleaning unit while rotating the photosensitive member and applying a bias of a polarity equal to a normal charging polarity of toner to the grid electrode and the discharging wire by the bias applying unit.

4. The image forming apparatus according to claim 3, further comprising a cleaning device configured to clean the photosensitive member, wherein the cleaning device recovers toner transferred from the grid electrode to the photosensitive member in the cleaning mode.

* * * * *